United States Patent [19]

Tohmiya

[11] Patent Number: 4,955,342

[45] Date of Patent: Sep. 11, 1990

[54] IDLE REVOLUTION NUMBER CONTROL APPARATUS FOR CARBURETER

[75] Inventor: Masato Tohmiya, Tokyo, Japan

[73] Assignee: Fuji Jukogyo Kabushiki Kaisha, Tokyo, Japan

[21] Appl. No.: 421,054

[22] Filed: Oct. 13, 1989

[30] Foreign Application Priority Data

Oct. 19, 1988 [JP] Japan ..... 63-263355

[51] Int. Cl.[5] ..... F02M 3/07

[52] U.S. Cl. ..... 123/339; 123/438; 261/41.5

[58] Field of Search ..... 123/339, 340, 341, 389, 123/438, 440; 261/41.5, 48, 57, DIG. 74; 62/323.1

[56] References Cited

U.S. PATENT DOCUMENTS

| | | | |
|---|---|---|---|
| 4,426,968 | 1/1984 | Onuki et al. | 123/339 |
| 4,612,892 | 9/1986 | Iwanaga et al. | 123/339 X |
| 4,655,181 | 4/1987 | Ohtaki et al. | 123/438 X |
| 4,662,333 | 5/1987 | Martel | 123/339 |
| 4,676,204 | 6/1987 | Inoguchi et al. | 123/339 X |
| 4,694,797 | 9/1987 | Hamai | 123/339 |
| 4,721,082 | 1/1988 | Hibino et al. | 123/339 |
| 4,766,862 | 8/1988 | Hibino et al. | 123/339 |

*Primary Examiner*—Willis R. Wolfe

*Attorney, Agent, or Firm*—Beveridge, DeGrandi & Weilacher

[57] ABSTRACT

An idling engine speed control apparatus for an engine with a carbureter having a main fuel passage for supplying fuel to an engine and a slow fuel passage for supplying fuel to the engine in accordance with an opening degree of a throttle valve mounted within the carbureter. There are provided an opener for opening and closing the throttle valve, and a bypass having a shutter valve, the bypass opening at the downstream of the throttle valve of the carbureter. The engine is subjected to an idle-up control by using at least one of the opener and the shutter valve of the bypass. The opener causes the throttle valve to open by a predetermined amount in accordance with the load conditions except that of an air conditioner, and the shutter valve of the bypass is opened when the air conditioner is used. The opener may cause the throttle valve to open for a predetermined time immediately after the start of using the air conditioner. The opener and the shutter valve of the bypass may be operated at a time when the air conditioner is used and the engine revolution number becomes lower than a predetermined value.

5 Claims, 4 Drawing Sheets

IDLE REVOLUTION NUMBER CONTROL APPARATUS FOR CARBURETER

BACKGROUND OF THE INVENTION

The present invention relates to a control apparatus for a carbureter for controlling an idling engine speed, and more particularly to a control apparatus having a combination of a plurality of idle-up means capable of retaining an optimum idling engine speed under any load condition.

As a conventional technique for controlling the idling engine speed of an engine with a carbureter, there is disclosed a technique, e.g., in Japanese Utility Model Laid-open Application No. 55-137234. According to this technique, a negative pressure responding unit as an idle-up means is cooperatively coupled to a throttle valve, and the throttle valve is opened or closed by actuating an electromagnetic valve in response to a signal from a calculation unit upon activation of the negative pressure responding unit in accordance with the negative pressure or an atmospheric pressure.

According to the above-described conventional technique, only the negative pressure responding unit cooperatively coupled to the throttle valve is used as the idle-up means, so that only a single high idling engine speed is obtained. As a result, if two or more loads are applied or if the operating condition of one load changes relatively greater a proper idling engine speed is not possible to be retained.

In recent years, air conditioners are widely used for vehicles. An air conditioner is often used during an idling state of the engine. The load of the air conditioner is imposed directly upon the engine and is very large as compared with another electric load. The load of the air conditioner also changes greatly with the temperature of atmosphere. It is therefore necessary to control the idling engine speed and retain an idle-up control of the engine, in accordance with whether or not the air conditioner is used and in accordance with the load condition of the air conditioner, while considering other load conditions.

SUMMARY OF THE INVENTION

The present invention has been made in consideration of the above problems, and it is an object of the present invention to provide a control apparatus for a carbureter for controlling an idling engine speed, which can always retain an optimum the idling engine speed irrespective of any load conditions including that of an air conditioner.

To achieve the above object, in the idling engine speed control apparatus of this invention, an opener is operatively coupled to a throttle valve, and a fuel bypass mounted with a shutter valve is operatively communicated with the downstream of the throttle valve. One or both of the opener and the bypass are selectively operated in accordance with the load conditions including that of an air conditioner to thereby conduct an idle-up control.

With the above arrangement, two control systems including the opener and the fuel bypass are selectively operated to obtain an optimum idle-up control in accordance with the load conditions mainly of the operation of the air conditioner and of other loads. If the engine speed reduces lower than a predetermined speed because of an increase of the air conditioner load, or the operation of both the air conditioner and other loads, both the control systems are operated to thereby retain a desired idling engine speed.

DESCRIPTION OF THE PREFERRED EMBODIMENT

Figure 1:
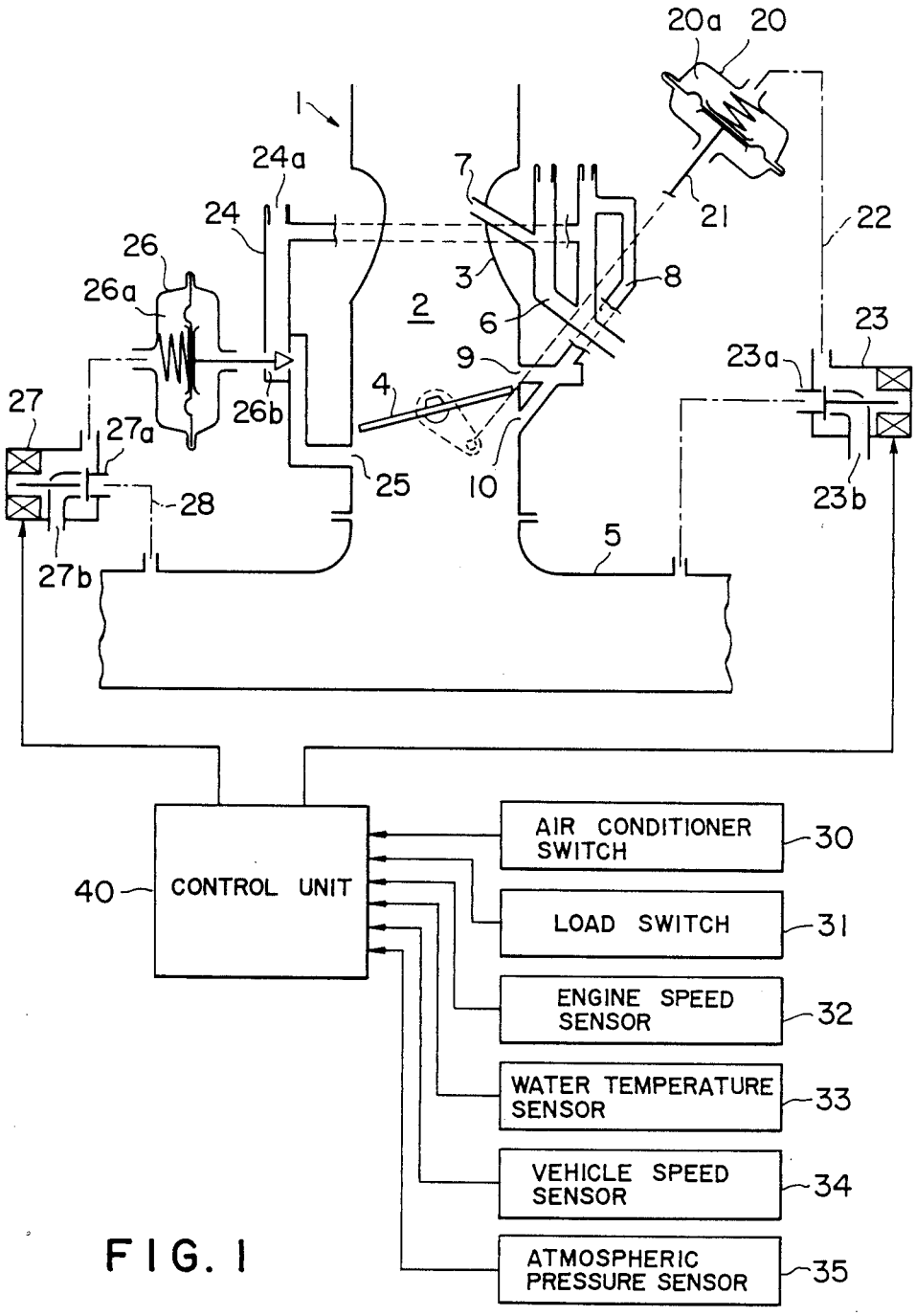
FIG. 1 is a schematic diagram showing an embodiment of an idling engine speed control apparatus for an engine with a carbureter according to the present invention.

Referring to FIG. 1, in a carbureter 1, there is mounted a throttle valve 4 in an induction passage 2 of an air-fuel mixture at the downstream of a venturi 3. At the downstream of the throttle valve 4 induction passage 2 communicates with an engine main body via an intake manifold 5. The venturi 3 has an opening for a main nozzle 7 which communicates with a main fuel passage 6. A slow port 9 and idle port 10 of a slow fuel passage 8 branching from the main fuel passage 6. The slow port 9 opens at the downstream of the throttle valve 4 at opening condition of the throttle valve 4 and opens at the upstream of the throttle valve 4 when the throttle valve 4 is closed. Opening of the idle port 10 into the carbureter 1 is at the position of the downstream of the throttle valve 4

The idling engine speed control system will then be described. The throttle valve 4 is mechanically coupled via a linkage mechanism 21 to a throttle opener 20 of a diaphragm type. The throttle opener 20 communicates with the air intake manifold 5 via a conduit 22. At the intermediate position of the conduit 22, there is provided a three-way solenoid valve 23. The three-way solenoid valve 23, when not energized, for example, closes a negative pressure port **23*a* and opens an atmospheric pressure port 23*b* to thereby induce air into a pressure chamber 20*a* of the throttle opener 20 and to freely maintain the throttle valve 4. Whereas the solenoid valve 23, when energized, closes the atmospheric pressure port 23*b* and opens the negative pressure port to thereby apply the air intake manifold negative pressure in the intake manifold to the pressure chamber 20*a* of the throttle opener 20, open the throttle valve 4** by a predetermined amount, and raise the idling engine speed.

As another idle-up means, there is provided a bypass 24 branching from the low fuel passage 8. The bypass 8 opens at a port 25 into the downstream of the throttle valve 4, and a shutter valve **26*b* actuated by a diaphragm is provided at the intermediate of the bypass 24. The diaphragm 26 communicates, via a conduit 28 having a solenoid valve 27 similar to the solenoid valve 23, with the air intake manifold 5. The solenoid valve 27, when not energized, for example, opens an atmospheric pressure port 27*b* to thereby introduce air into a pressure chamber 26*a* and close the shutter valve 26*b*. Whereas the solenoid valve 27, when energized, opens a negative pressure port 27*a* to apply the negative pressure to the pressure chamber 26*a* and open the shutter valve 26*b*. The bypass 24** is adapted to obtain a larger idling engine speed than that when the throttle opener 20 is actuated to open the throttle valve 4, by opening the shutter valve 26*b* and inducing the mixture by the negative pressure. The mixture is induced from the bypass 24 to the intake manifold with a predetermined air/fuel ratio by means of an economizer 24*a* mounted at the bypass 24 when the shutter valve 26*b* opens.

In order to detect the load conditions, engine operating conditions and the like, there are provided an air conditioner switch 30, a plurality of load switches 31 for a head lamp switch, fan switch, power steering switch and the like, engine speed sensor 32, water temperature sensor 33, vehicle speed sensor 34, and atmospheric pressure sensor 35. Signals from these sensors and switches are inputted to and processed at a control unit 40 to energize one or both of the solenoid valves 23 and 27.

Figure 2:
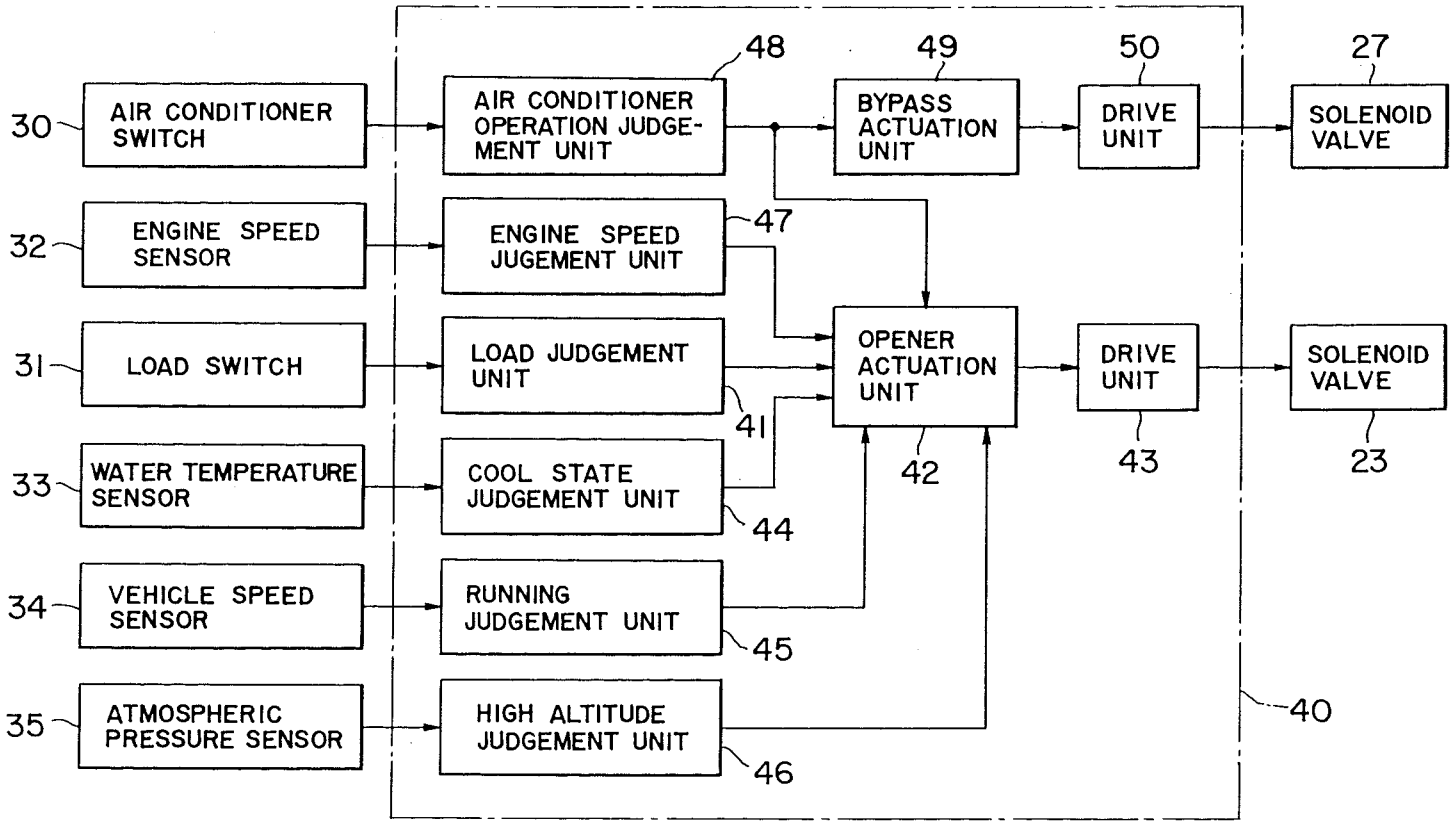
FIG. 2 is a block diagram showing the control unit shown in FIG. 1.

The control unit 40 will be described in more detail with reference to FIG. 2. A signal from one of the load switches 31 is inputted to a load judgement unit 41 which outputs a load signal to an opener actuation unit 42 to energize the solenoid valve 23 via a drive unit 43. A cool state judgement unit 44 inputted with a signal from the water temperature sensor 33, a running judgement unit 45 inputted with a signal from the vehicle speed sensor 34, and a high altitude judgement unit 46 inputted with a signal from the atmospheric pressure sensor 35, output judgement signals to the opener actuation unit 42 to energize the solenoid valve 23. A signal from the engine speed sensor 32 is inputted to an engine speed judgement unit 47 which calculates the engine speed Ne. The engine speed judgement unit 47 outputs to the opener actuation unit 42, an ordinary idling engine speed N1 (e.g., 800 rpm), a high set speed N1 (e.g., 900 rpm), low set speed N2 (e.g., 780 rpm), or N3 (e.g., 600 rpm). A signal from the air conditioner switch 30 is inputted to an air conditioner operation judgement unit 48 which outputs an air conditioner operation signal to a bypass actuation unit 49 to energize the solenoid valve 27 via a drive unit 50. The air conditioner operation signal is also applied to the opener actuation unit 42 to operate the throttle opener 20 when the engine speed Ne is smaller than or equal to N2, or stop the opener 20 when Ne is larger than or equal to N1.

Figure 3:
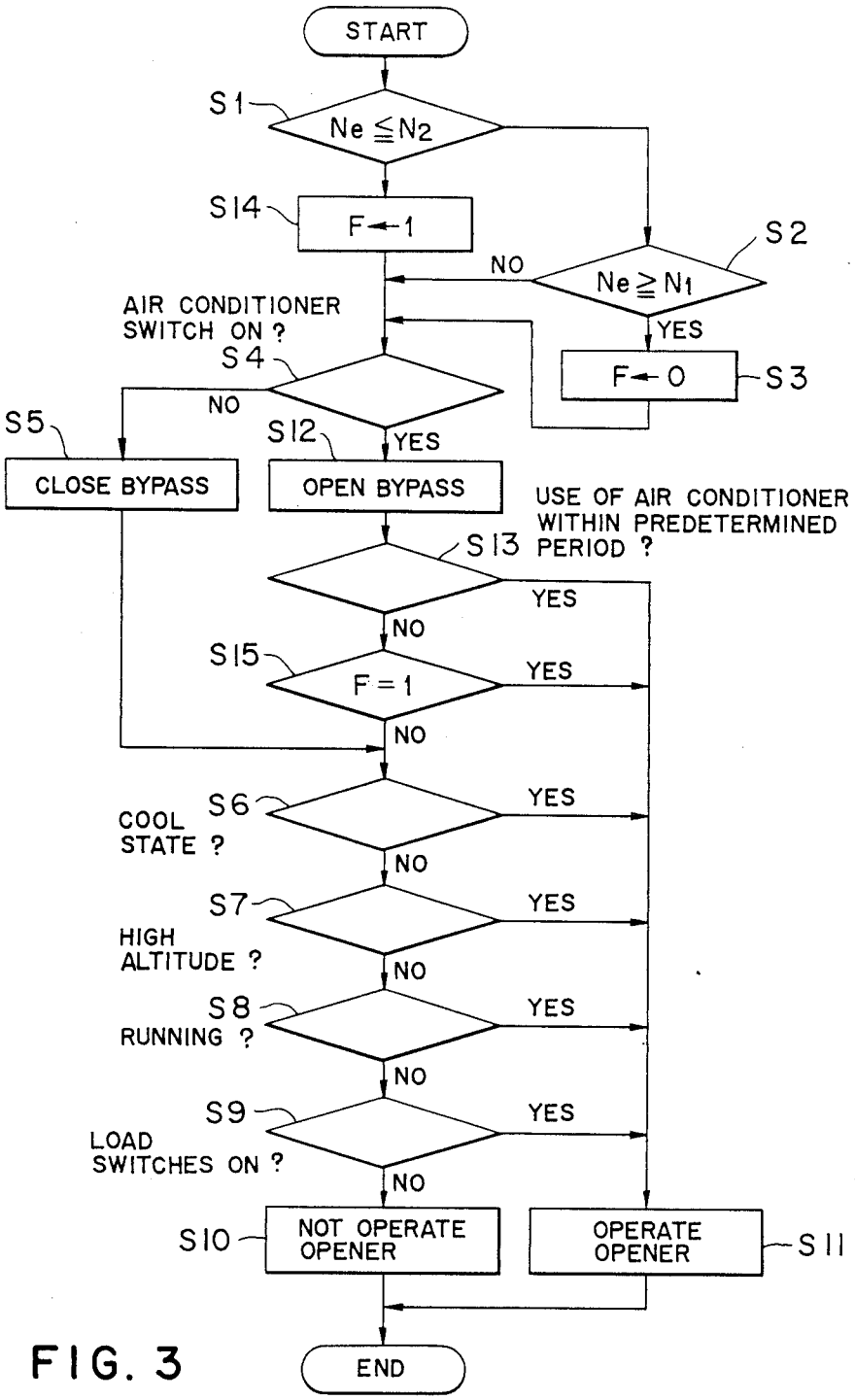
FIG. 3 is a flow chart illustrating the operation of the apparatus.
Figure 4:
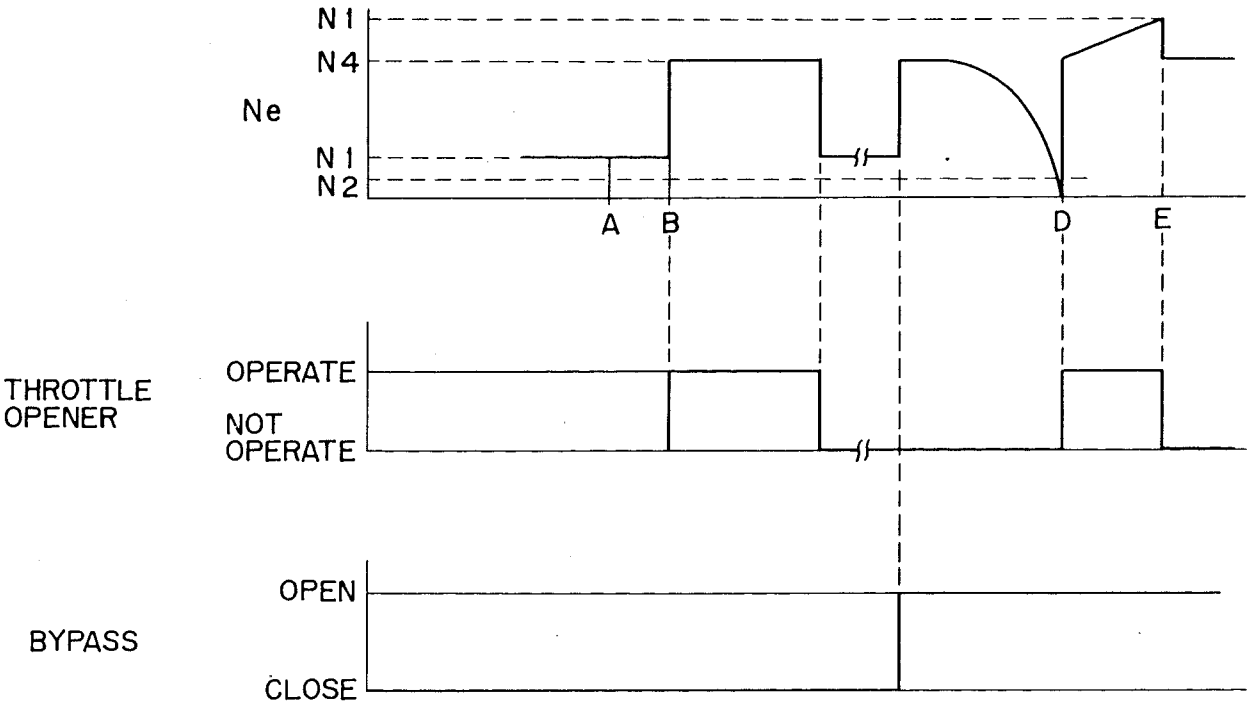
FIG. 4 is a characteristic graph showing the idle-up control.

The operation of the idling engine speed control apparatus constructed as above will be described with reference to the flow chart shown in FIG. 3 and the operation characteristic graph shown in FIG. 4.

During the idling condition of the engine, the signals from the engine speed, water temperature, vehicle speed, and atmospheric pressure sensors and the signals from the air conditioner, and other load switches are supplied to the control unit 40. Then, the cool state, running, air conditioner operation, load, and high altitude judgement signals are supplied to the opener actuation unit 42 and bypass actuation unit 49 to thereafter execute the procedure shown in the flow chart of FIG. 3. Specifically, if the air conditioner is not operated and the engine speed Ne is $N2 \leqq Ne \leqq N1$, then the flow proceeds from step S1 to steps S2, S4, S5 and S6. At step S6, if it is not in a cool state, the flow advances to step S7, if not a high altitude, to step S8, if not running, to step S9, and if not generating the load such as the head lamp utilizing electric power, to step S10 whereat the opener actuation unit 42 is operated not to energize the solenoid valve 23. The pressure chamber 20*a* of the throttle opener 20 is therefore introduced with atmospheric air to make the throttle valve 4 free. In this case, the solenoid valve 27 is also not energized so that the shutter valve 26*b* is closed by the diaphragm 26 inducing atmospheric air to the pressure chamber 26*a*. Consequently, both the solenoid valves 23 and 27 do not operate to allow an idle-up control. The throttle valve 4 is therefore closed at a predetermined idle position near the complete close position so that mixture is supplied only from the idle port 10 to thereby retain a predetermined idling engine speed NI of, e.g., 800 rpm (indicated at A in FIG. 4).

If the air conditioner is not operated and the water temperature is lower than a predetermined value, i.e., in the cool state, then the flow proceeds from step S6 to S11. If the atmospheric pressure is lower than a predetermined value, i.e., in a high land running state, then the flow advances to step S11. The opener actuation unit 42 therefore energizes the solenoid valve 23 so that the throttle valve 4 is opened to a predetermined opening degree by the throttle opener 20 to obtain a higher idling engine speed N4 of, e.g., 900 rpm (indicated at B in FIG. 4). If during running or generating the load such as the lamp, the flow advances from step S8 or step S9 to step S11 so that the throttle opener 20 operates to conduct the idle-up control.

If the air conditioner is operated, the flow advances from step S4 to step S12 whereat the bypass actuation unit 49 energizes the solenoid valve 27 to open the shutter valve 26*b* by the diaphragm 26 inducing the negative pressure so that mixture is supplied from the bypass 24. In this case, the amount of mixture from the bypass 24 is set so as not to lower the idling engine speed for a large air conditioner load, thereby ensuring a sufficient idle-up control. At step S13, the throttle opener 20 is operated at the same time for a predetermined time after the air conditioner switch 30 was turned on, thereby dealing with an abrupt load change.

During the operation of the air conditioner, if the engine speed Ne lowers smaller than N2 because of an increase in the air conditioner load due to a rise in atmospheric air temperature, because of turning on of a plurality of load switches 31, or the like, then the flow advances from step S1 to step S14 to set a flag. Thereafter, the flow advances from step S15 to step S11 so that the throttle opener 20 is also actuated to achieve the idle-up control (indicated at D in FIG. 4). At this time, if the engine speed Ne increases more than N1, the flow advances from step S2 to S3 whereat the flag is reset. Therefore, the flow advances from step S15 to step S6. In the non-operation condition of the throttle opener 20, the flow allows to advance from step S6 to step S10 and the throttle valve 4 is returned to the non-operation position at step S10, so that the idling engine speed takes the ordinary speed (indicated at E in FIG. 4).

During the running a vehicle (step S8), the running judgement unit 45 supplies the running judgement signal to the opener activation unit 42 to actuate the throttle opener 20 to open the throttle valve, and after a predetermined time (e.g., 1.2 sec) after the stop of running, close the throttle valve. The running judgement unit 45 therefore operates as a dish pot during deceleration.

The embodiment of the present invention has been described so far. The invention is not limited to this embodiment only. The number of idle-up means is not also limited to two, and various control methods are possible.

As appreciated from the foregoing description of the present invention, the carbureter has two idle-up means including the throttle opener and the bypass. Therefore, a load change can be dealt with so as to retain an optimum idling engine speed for any load conditions.

A combination of the throttle opener and the bypass independent from the throttle opener can prevent an excessive opening of the throttle valve.

Further, during operation of the air conditioner, the mixture is supplied from the bypass so that the control apparatus can sufficiently deal with high load condition.

Still further, the idle-up control can be conducted advantageously by the throttle opener in accordance with not only the water temperature but also the atmospheric pressure, electric power and other loads.

What is claimed is:

1. An idling engine speed control apparatus for an engine with a carbureter having a main fuel passage for supplying fuel to the engine and a slow fuel passage for supplying fuel to the engine in accordance with an opening degree of a throttle valve mounted within the carbureter comprising:

throttle opener means for opening said throttle valve to a predetermined opening degree;

bypass means for selectively supplying fuel to the downstream of said throttle valve;

load detector means for detecting a plurality of load conditions of said engine and producing load signals;

engine operating condition detector means for detecting an engine operating condition and producing an engine operating condition signal; and control means responsive to the load signals and to the engine operating condition signal for determining an idling condition and for actuating one or both of said throttle opener means and bypass means.

2. An idling engine speed control apparatus according to claim 1, wherein said opener means causes said throttle valve to open in accordance with the load conditions except that of an air conditioner; and said bypass means is actuated when said air conditioner is operated.

3. An idling engine speed control apparatus according to claim 2, wherein said opener means causes said throttle valve to open for a predetermined time immediately after the start of operating said air conditioner.

4. An idling engine speed control apparatus according to claim 1, wherein said opener means and said bypass means are operated at a time when said air conditioner is operated and the engine speed becomes lower than a predetermined value.

5. An idling engine speed control apparatus according to claim 1, wherein said bypass means comprises a shutter valve selectively opened and closed by the control means.

* * * * *